United States Patent [19]

Zehel et al.

[11] 4,187,417

[45] Feb. 5, 1980

[54] PRINTED CIRCUIT CONTACT

[75] Inventors: Joseph J. Zehel, Milwaukee; Joseph W. Kreis, West Bend, both of Wis.

[73] Assignee: Globe-Union Inc., Milwaukee, Wis.

[21] Appl. No.: 874,503

[22] Filed: Feb. 2, 1978

[51] Int. Cl.[2] ..... H01H 1/42; H01H 21/54

[52] U.S. Cl. ..... 200/254; 200/15

[58] Field of Search ..... 200/253, 254, 275, 15, 200/16 F, 252

[56] References Cited

U.S. PATENT DOCUMENTS

| | | | |
|---|---|---|---|
| 1,799,099 | 3/1931 | Johnson | 200/15 |
| 2,828,393 | 3/1958 | Wingard | 200/254 |
| 3,209,110 | 9/1965 | Meyer | 200/254 |
| 3,308,248 | 3/1967 | Stephan et al. | 200/11 |
| 4,086,548 | 4/1978 | Robbins et al. | 200/254 X |

OTHER PUBLICATIONS

Oak Industries, Inc., 2 5/16" diameter rotary switch-type MF, Sp571.

Centralab, Series 070 rotary switch-one piece pc clip/-terminal, 8-1-78.

*Primary Examiner*—Steven M. Pollard

*Attorney, Agent, or Firm*—John Phillip Ryan; Joseph J. Jochman, Jr.

[57] ABSTRACT

A printed circuit contact of the type for attachment to a control device such as a rotary switch and a method for forming the printed circuit contact, the printed circuit contact comprising an elongated rigid tail resistant to bending and an integrally connected spring clip comprised of a pair of resilient jaws, the jaws being formed from material having a thickness less than the thickness of the tail and wherein the jaws and the tail are formed from a single piece of material. The method of forming the printed circuit contact includes milling a longitudinal groove in one surface of a strip of sheet stock so that a portion of the sheet stock is substantially thinner than the remainder. The sheet stock is then stamped and subjected to bending operations such that the thinner milled portion of the sheet stock is employed to form the jaws of the clip and the thicker portion of the stock forms the tail.

11 Claims, 7 Drawing Figures

PRINTED CIRCUIT CONTACT

BACKGROUND OF THE INVENTION

1. Field of the Invention

The present invention relates to electrical control devices such as rotary switches and more particularly to printed circuit contacts for attachment to such control devices and for providing an electrical connection to a printed circuit board.

2. Description of the Prior Art

Rotary switches and other control devices such as potentiometers and pushbutton switches are frequently used with printed circuit boards. To facilitate such use these control devices frequently include a plurality of printed circuit contacts each having a tail or terminal received in an aperture in the printed circuit board. The printed circuit contacts are intended to provide electrical connection between a rotatable contact disc of the rotary switch and the circuits of the printed circuit board. To provide for electrical contact between the rotatable contact disc of the rotary switch and the printed circuit contacts, one end of the printed circuit contacts includes a spring clip making sliding contact with the periphery of the disc.

During the manufacture of a printed circuit board employing a rotary switch, for example, the tails of the printed circuit contacts of the rotary switch are forced through apertures in the printed circuit boards such that the ends of the tails extend through the lower side of the circuit board. Solder is then applied to the lower surface of the circuit board to provide an electrical connection between the ends of the printed circuit contacts and the circuits of the printed circuit board.

Since the tail of the printed circuit contact is forced through the circuit board, the tail must be strong enough to resist bending under a substantial force. However, the jaws comprising the spring clip at the opposite end of the printed circuit contact must be substantially flexible. Each of the spring clips is intended to selectively receive the switch contact disc therebetween and the contact disc slides between the jaws of the selected spring clips. It will be appreciated that the jaws of the spring clips must be sufficiently resilient that they are biased against the surfaces of the contact disc to ensure a good electrical connection. However, the jaws of the spring clips must also be sufficiently flexible that they exert only a small force against the surfaces of the disc to avoid undue wear of the contact disc. If the jaws exert excessive pressure on the contact disc, the rotary switch will wear rapidly and have an unduly short life.

The spring clips and tails of the printed circuit contacts are generally comprised of full hard brass. Using full hard brass it has been found that it is generally necessary that the jaws of the spring clips be formed from material which is between 0.005 to 0.008 inches in thickness in order to provide the required flexibility and resilience to the jaws that they will maintain electrical contact with the contact disc yet avoid undo wear of the contact disc. However, when automated equipment is used to join control devices of the type having conventional printed circuit contacts to a printed circuit board, the tails of such contacts are usually insufficiently strong to withstand bending forces applied to them, when its ends are forced into apertures in a printed circuit board, unless the tails are formed of material substantially thicker than the material comprising the jaws of the spring clip.

Accordingly, prior art attempts to increase the resistance of the tails to bending have included forming the printed circuit contact in such a manner that the tail is comprised of two folded adjacent thicknesses of material as illustrated by the prior art printed circuit contact shown in FIG. 4. However, tails of such printed circuit contacts are still not sufficiently strong to withstand bending forces when the ends of the tails are forced into apertures of a printed circuit board using automated equipment. To further increase the strength of the tails, other prior printed circuit contacts have been comprised of two sections mechanically joined together, one part comprising the tail and the other providing the spring clip portion. However, such composite printed circuit contacts are too expensive to be commercially practical. Such printed circuit contacts are illustrated on page 8 of an advertizing publication from Oak Industries Inc., Switch Division, Crystal Lake, Ill. entitled Oak Sales Bulletin, 2 5/16 Diameter Rotary Switch Type MF (1974).

SUMMARY OF THE INVENTION

The present invention provides an improved printed circuit contact of the type for use with a rotary switch, the printed circuit contact being economical to manufacture and having a rigid tail which can be forced into the apertures of a printed circuit board without bending. The present invention also provides a method for making the printed circuit contact.

The printed circuit contact of the invention has a onepiece construction and generally includes a body portion supporting one of the spring clip jaws, a tail portion integrally joined to the body portion and extending angularly with respect to the body portion, and a jaw supporting tab also integrally attached to the body portion and supporting a second jaw of the spring clip. The jaws comprising the spring clip are each formed from material having a thickness less than the thickness of the body portion and that of the tail.

The method of the invention for forming a printed circuit contact generally includes the steps of milling a longitudinal groove in one surface of a strip of suitable metal stock which has a thickness for forming a bend resistant tail and then shearing and bending the metal stock appropriately to form the printed circuit contact. More specifically, following the milling operation, that portion of the stock having a decreased thickness due to the milling operation is trimmed to form blanks for defining the jaws of the spring clip. These blanks are then subjected to coining operations and bending operations to form the jaws. The stock adjacent the milled groove is also trimmed to form a jaw supporting tab, and the jaw supporting tab is folded over such that the jaws form a spring clip. The stock is then sheared to form the body portion and the tail of the printed circuit contact.

The method of the invention provides an economical mode of manufacturing printed circuit contacts from a single piece of sheet stock and also facilitates manufacture of printed circuit contacts having a tail comprised of material which can be substantially thicker than the material comprising the jaws of the spring clip.

DESCRIPTION OF A PREFERRED EMBODIMENT

Figure 1:
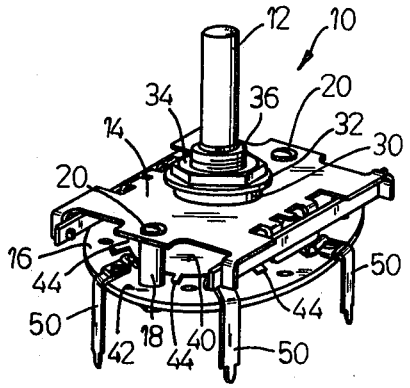
FIG. 1 PRIOR ART
FIG. 1 is a perspective view of a rotary switch having printed circuit contacts of the invention.
Figure 4:
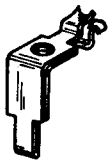
FIG. 4 is an enlarged perspective view of a prior art printed circuit contact

A single section rotary switch 10 employing printed circuit contacts of the invention is shown in FIG. 1 and generally includes a central rotatable switch shaft 12 supported by a side thrust switch index plate 14 and a phenolic or ceramic insulative annular switch stator 16. It should be understood that the rotary switch 10 is of a type well known in the art and is shown to illustrate the printed circuit contacts of the invention. The printed circuit contacts of the invention could also be used in connection with any type of control device requiring spring contacts and a means for connection to a circuit board, such control devices including other types of rotary switches, potentiometers, or pushbutton switches.

The side thrust switch index plate 14 of the rotary switch 10 and annular switch stator 16 are held in generally parallel spaced apart relation by a pair of spacer sleeves 18 and mounting screws 20 extending coaxially through the spacer sleeves 18 and through both the switch index plate 14 and the discoidal switch stator 16. The lower end of the mounting screw 20 extends through the discoidal switch stator 16 and supports a washer 22, a lock washer 24 and a nut 26.

An annular rotor retainer 28 (FIG. 2) is rigidly secured to the lower end of the switch shaft 12 and its upper surface is received against the lower surface of the annular siwtch stator 16. The rotor retainer 28 is intended to rotate with switch shaft 12 and is moveable with respect to the lower surface of the switch stator 16. A bushing 30 surrounds the switch shaft 12 and is positioned against the upper surface of the switch index plate 14. A lock washer 32 and panel mounting nut 34 are respectively disposed above the bushing 30 and surround switch shaft 12, the panel mounting nut 34 threadably being received on a threaded sleeve 36 integrally joined to the bushing 30.

The switch shaft 12 includes flats 38 intermediate the discoidal switch stator 16 and the switch index plate 14, and an annular contact disc 40 surrounds the switch shaft 12 and is positioned against the upper surface 42 of the discoidal switch stator 16 and the contact disc 40 is connected to the switch shaft for rotation with the switch shaft 12.

The contact disc 40 is provided with a plurality of contacts 44 extending radially outwardly from its periphery. Upon rotation of the switch shaft 12 and contact disc 40, the contacts 44 are intended to selectively engage spring clips 46 of printed circuit contacts 50 to thereby provide electrical connection between selected ones of the printed circuit contacts.

Figure 3:
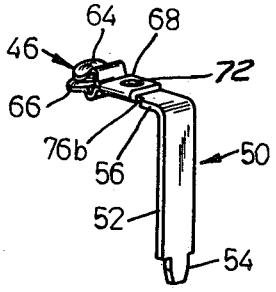
FIG. 3 is an enlarged perspective view of one of the printed circuit contacts shown in FIG. 1.
Figure 2:
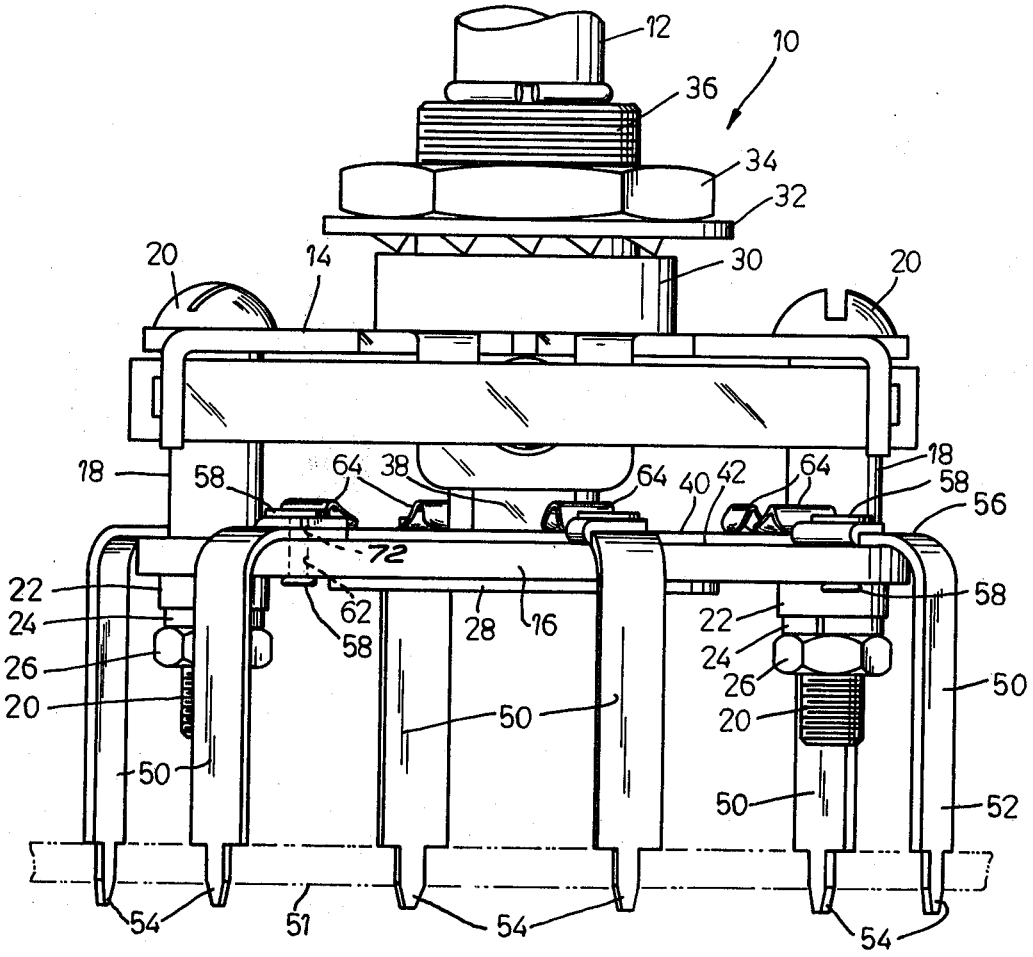
FIG. 2 is an enlarged side elevation view of the rotary switch shown in FIG. 1 and shows the ends of the printed circuit contacts received in a circuit board shown in phantom.

The printed circuit contacts 50 are rigidly secured to the switch stator 16 and are generally intended to provide an electrically conductive path between the contact disc 40 and printed circuit paths of a printed circuit board 51 shown in phantom in FIG. 2. The printed circuit contacts 50 include a tail 52, having a free end forming a plug 54 and intended to plug into apertures in the printed circuit board 51. The printed circuit contacts also include a body portion 56 rigidly secured against the upper surface of the switch stator 16 by an eyelet or rivet 58 which extends through a hole 72 (FIG. 3) in the body portion 56 and an aligned bore 62 extending through the discoidal switch stator 16.

The body portion 56 of the printed circuit contact 50 is integrally connected at one of its end to the tail 52 and has a longitudinal axis generally perpendicular to that of the tail 52. The free end of the body portion 56 forms a spring clip comprised of an upper jaw 64 and a lower jaw 66. In a preferred embodiment of the invention, the tail 52 and body portion 56 of the printed circuit contact are formed from full hard brass having a material thickness of approximately 0.018 inches (0.71 mm) and the jaws 64 and 66 comprising the spring clip have a thickness of approximately 0.0055 inches (0.197 mm). It is generally desirable that the jaws 64 and 66 be comprised of material having a thickness of between 0.005 to 0.008 inches so that the jaws of the spring clip apply a suitable pressure to the contacts 44 of the contact disc 40. Jaws comprised of material having a greater thickness would provide undue pressure on the contacts thereby resulting in substantial wear of the contacts, reducing the useful life of the rotary switch 10.

The upper jaw 64 of the spring clip is integrally connected to a jaw supporting tab 68 in turn integrally joined to the body portion 56 and folded over the upper surface of the body portion 56 about an axis adjacent one edge of the body portion 56 and being generally parallel to the longitudinal axis of the body portion 56.

Figure 5:
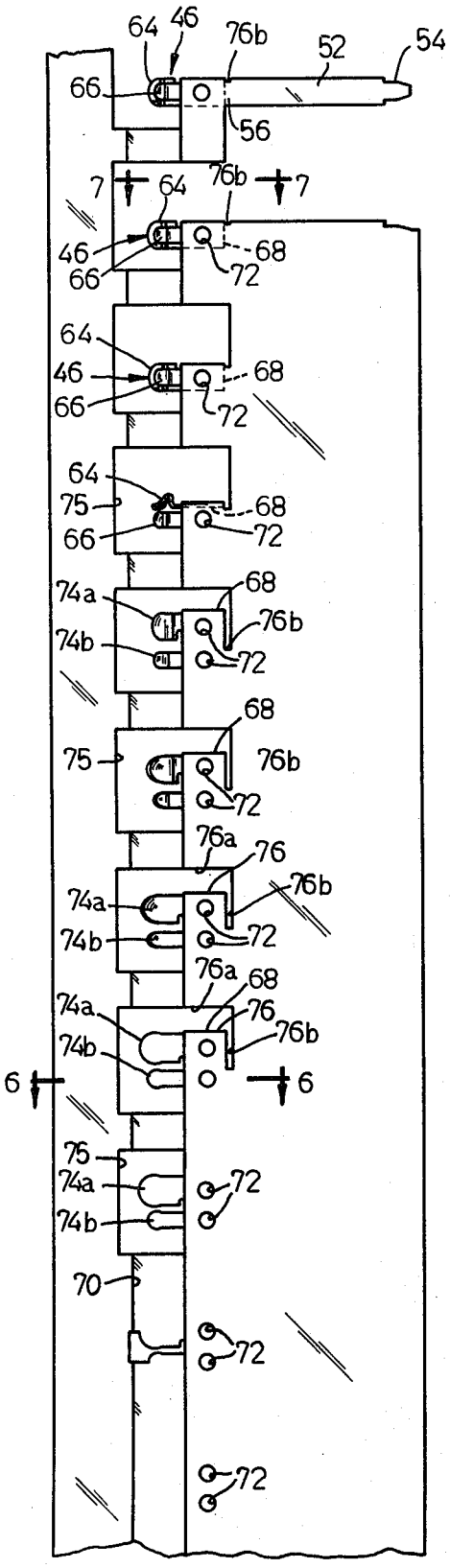
FIG. 5 is a plan view of a strip of sheet stock used to manufacture the printed circuit contact of the invention, and shows steps employed in forming the printed circuit contact from the strip of sheet stock.
Figure 7:
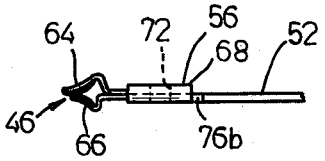
FIG. 7 is a cross-section view taken along line 7—7 in FIG. 5.
Figure 6:
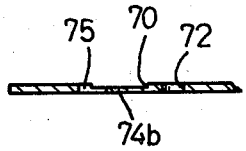
FIG. 6 is a cross-section view taken along line 6—6 in FIG. 5.

A preferred method of manufacturing the printed circuit contacts 50 is illustrated in FIGS. 5–7. A strip of full hard brass having a thickness of approximately 0.018 inches is milled to form a longitudinal groove 70 in one of its surfaces to thereby reduce the thickness of the strip to approximately 0.005 inches. The strip is also machined to provide a series of pairs of holes 72 therethrough, the holes 72 being spaced from but adjacent one edge of the groove 70. The milled brass strip is then fed through cutting and bending apparatus to perform a series of cutting and bending steps to form a finished printed circuit contact. The first steps of the manufacturing operation include cutting or trimming the sheet stock in the area of the groove 70 to form an aperture 75 therein, the aperture 75 defining blanks **74*a* and 74*b* for making the jaws 64 and 66**, respectively, of the spring clip. The jaw blanks are formed from the milled portion of the strip and accordingly have a thickness of approximately 0.005 inches.

The sheet stock is then further trimmed to cut an undercut notch 76 in the strip material adjacent the groove 70 to form the support tab 68 for the upper jaw 64. The undercut notch 76 includes a notch portion **76*a* perpendicular to the groove 70, spaced therefrom and intersecting notch portion 76*b*, the notch portion 76*b* having a length approximating the width of blank 74*a***.

The blanks **74*a* and 74*b* are then subjected to a coining operation such that the blanks have a dished or concave configuration. The coined blanks 74***a* and 74*b* are then further subjected to bending operations to form them into the desired configuration of the respective upper and lower jaws 64 and 66.

The support tab 68 and the jaw 64 integrally supported by the tab 68 are then bent downwardly and folded over, the support tab 68 being folded against the bottom surface of the stock strip and so that the jaws 64 and 66 are in opposed relationship to form a spring clip and in such a manner that adjacent holes 72 are coaxially aligned for receiving an eyelet 58. The support tab 68 is folded 180° around a bend line extending parallel to the jaws 64 and 66 equidistant the holes 72 and generally equidistant the jaws 64 and 66 such that the jaw supporting tab 68 is juxtapositioned against the lower surface of that portion of the sheet stock supporting jaw 74*b*. The strip is then further trimmed to form the body portion 56 and the tail 52 of the plug-in tail clip and whereby the printed circuit contact 50 is sheared from the stock strip. A finished printed circuit contact 50 is then formed by bending the tail so that the tail 52 and spring clip supporting portion 56 are generally perpendicular.

It will be readily appreciated by those skilled in the art that the length of the tail 52 of the printed circuit contact can be varied as required by merely altering the width of the strip stock employed.

We claim:

1. A one piece printed circuit contact for attachment to an insulative substrate of an electrical control device, the contact being electrically conductive and comprising:

a body portion for attachment to said substrate, said body portion having opposite ends, opposite faces and longitudinal edges;

a first jaw integrally attached to one end of said body portion;

a jaw supporting tab in juxtaposition with one face of said body portion and integrally joined to one edge of said body portion;

a second jaw integrally attached to said jaw supporting tab and in parallel adjacent relationship with said first jaw, said first and second jaws forming a spring clip; and, a tail integrally joined to the other end of said body portion and angularly disposed with respect to said body portion, said tail comprising a single material thickness and having an end defining a plug, and wherein the thickness of said tail is greater than the thickness of at least one of said jaws.

2. The printed circuit contact set forth in claim 1 wherein said jaw supporting tab and said body portion are each of a thickness substantially equal to the thickness of said tail.

3. The printed circuit contact set forth in claim 1 wherein said body portion includes an aperature therethrough for receiving an eyelet whereby said body portion can be secured to said substrate.

4. A one piece printed circuit conductive contact/terminal assembly for an electrical control device comprising:

a body portion for attachment to said device, said body material comprising a first thickness and having opposite ends;

jaw means integrally formed on and extending from one of said body ends, said jaw means including a pair of jaw members comprising in combination a second thickness with said second thickness being relatively thinner than said first thickness; and, terminal means integrally formed on and extending from the other of said body ends, said terminal means material comprising said first thickness.

5. The one piece printed circuit conductive contact/terminal assembly of claim 4 in which said jaw members are in coaxial parallel adjacent relationship and form a spring contact clip.

6. The one piece printed circuit conductive contact/terminal assembly of claim 4 whereby the terminal means is angularly disposed with respect to said body portion.

7. A unitary printed circuit conductive contact/terminal assembly for an electrical control device, comprising:

a single piece part metal member having a first thickness portion and a second thickness portion, said second thickness portion being relatively thinner than said first thickness portion;

a body portion for attachment to said device formed in said metal member's first thickness portion;

a pair of jaw members formed in and the combined thickness of which comprises said metal member's second thickness portion, said jaw members adjoining and extending from said body portion at a first point; and, terminal means formed in said metal members's first thickness portion adjoining and extending from said body portion at a second point, said body portion second point being displaced from said body portion first point.

8. The unitary printed circuit conductive contact/terminal assembly of claim 7 in which the body portion first and second points are opposed ends thereof.

9. The unitary printed circuit conductive contact/terminal assembly of claim 7 in which said jaw members are in coaxial parallel adjacent relationship and form a spring contact clip.

10. The unitary printed circuit conductive contact/terminal assembly of claim 8 in which said body portion includes a support tab adjoining and extending from said body at a third point, said support tab including at least a portion of said body first point, one of said jaw members extending from the first point of said body portion and the other of said jaw members extending from that portion of the first point formed by said support tab, said support tab being formed to overlie said body portion whereby said jaw members lie in a coaxial parallel adjacent relationship to form a spring contact clip.

11. The unitary printed circuit conductive contact/terminal assembly of claim 7 whereby the terminal means is angularly disposed with respect to said body portion.

* * * * *